US005279642A

United States Patent [19]

Ohtera

[11] Patent Number: 5,279,642

[45] Date of Patent: Jan. 18, 1994

[54] PROCESS FOR PRODUCING HIGH STRENGTH ALUMINUM-BASED ALLOY POWDER

[75] Inventor: Katsumasa Ohtera, Yamato, Japan

[73] Assignee: Yoshida Kogyo K.K., Tokyo, Japan

[21] Appl. No.: 909,775

[22] Filed: Jul. 7, 1992

[30] Foreign Application Priority Data

Sep. 5, 1991 [JP] Japan ..... 3-225972

[51] Int. Cl.[5] ..... C22C 21/00

[52] U.S. Cl. ..... 75/351; 148/403; 420/550; 420/551

[58] Field of Search ..... 75/351; 148/403; 420/550, 551

[56] References Cited

U.S. PATENT DOCUMENTS

| | | | |
|---|---|---|---|
| 4,729,790 | 3/1988 | Skinner | 420/551 |
| 4,909,867 | 3/1990 | Masumoto et al. | 420/550 |
| 4,950,452 | 8/1990 | Masumoto et al. | 420/550 |
| 4,964,927 | 10/1990 | Shiflet et al. | 420/551 |

OTHER PUBLICATIONS

Atzmon Phys. Rev. Letts. 64 (1990) 487.

Hellstern et al in MRS Symp., Boston, Nov. 1988.

*Primary Examiner*—Upendra Roy

*Attorney, Agent, or Firm*—Flynn, Thiel, Boutell & Tanis

[57] ABSTRACT

Disclosed herein is a process for producing a high strength aluminum-based alloy powder comprising mixing Al or Al alloy powder with an Al—T—X alloy powder, wherein T is at least one selected from the group consisting of V, Cr, Mn, Fe, Co, Ni, Cu, W, Ca, Li, Mg and Si; X is at least one selected from the group consisting of Y, Nb, Hf, Ta, La, Ce, Sm, Nd, Zr and Ti or Mm; and mechanically alloying the formed powder mixture. The aluminum-based alloy powder is excellent in workability and reliability by virtue of its high strength stability in the temperature range of from room temperature to an elevated temperature, its excellent ductility in the same temperature range and its low thermal expansion coefficient in the same temperature range.

11 Claims, No Drawings

PROCESS FOR PRODUCING HIGH STRENGTH ALUMINUM-BASED ALLOY POWDER

BACKGROUND OF THE INVENTION

1. Field of the Invention

The present invention relates to a process for producing a high strength Al-based alloy powder having excellent heat resistance. More particularly, it pertains to a process for producing an Al-based alloy powder which is produced by mechanical alloying (the MA method).

2. Description of the Prior Art An Al-based alloy having high strength and high heat resistance has heretofore been produced by the liquid quenching method. In particular, an Al-based alloy having the above-mentioned composition is disclosed in Japanese Patent Laid-Open No. 1-275732. The Al-based alloy obtained by the liquid quenching method has an amorphous or fine crystalline structure and is an excellent alloy having high strength, high heat resistance and high corrosion resistance. There is also disclosed therein that the aforesaid alloy is obtained by direct mechanical alloying (MA method).

The Al-based alloy which is produced by the liquid quenching method or the mechanical alloying method as disclosed in the above Japanese Patent Laid-Open No. 1-275732 is an excellent alloy exhibiting high strength, high heat resistance and high corrosion resistance but still leaves some room for improvement with respect to strength, thermal expansion coefficient and ductility in the temperature range of from room temperature to an elevated temperature. These properties are particularly important in the case where the alloy powders obtained are compacted and made into a consolidated material by the use of existing powder metallurgical techniques.

SUMMARY OF THE INVENTION

An object of the present invention is to provide a process for producing a high strength aluminum-based alloy powder having a high strength, a low thermal expansion coefficient, and ductility in the temperature range of from room temperature to an elevated temperature.

According to the present invention, there is a process for producing a high strength aluminum-based alloy powder, which comprises mixing aluminum powder with an alloy powder having a specific composition and mechanically alloying the powder mixture thus obtained.

As the alloy powder to be mixed with the aluminum powder, the following powder is used.

(1) An alloy powder having the composition represented by the formula $Al_{1-x1-y1}T_{x1}X_{y1}$, wherein T is at least one element selected from the group consisting of V, Cr, Mn, Fe, Co, Ni, Cu, W, Ca, Li, Mg and Si; X is at least one element selected from the group consisting of Y, Nb, Hf, Ta, La, Ce, Sm, Nd, Zr and Ti or Mm (misch metal); and x1 and y1 are each an atomic proportion and satisfy the relations $0.005 \leqq x1 \leqq 0.35$, $0.005 \leqq y1 \leqq 0.25$.

(2) An alloy powder having the composition represented by the formula $Al_{1-x2-y2}Ni_{x2}Ln_{y2}$, wherein Ln is at least one element selected from the group consisting of Y, La, Ce, Zr and Ti or Mm (misch metal); and x2 and y2 are each an atomic proportion and satisfy the relations $0.03 \leqq x2 \leqq 0.15$, $0.01 \leqq y2 \leqq 0.10$.

(3) An alloy powder having the composition represented by the formula $Al_{1-x2-y2-z}Ni_{x2}M_zLn_{y2}$, wherein M is at least one element selected from the group consisting of Fe, Co, Mn and Cr; Ln is at least one element selected from the group consisting of Y, La, Ce, Zr and Ti or Mm (misch metal); and x2, y2 and z are each an atomic proportion and satisfy the relations $0.03 \leqq x2 \leqq 0.15$, $0.01 \leqq y2 \leqq 0.10$, $0.001 \leqq z \leqq 0.01$.

DESCRIPTION OF PREFERRED EMBODIMENTS

The first aspect of the present invention relates to a process for producing a high strength Al-based alloy powder by mixing Al powder with an alloy powder having the composition represented by the formula $Al_{1-x1-y1}T_{x1}X_{y1}$, wherein T is at least one element selected from the group consisting of V, Cr, Mn, Fe, Co, Ni, Cu, W, Ca, Li, Mg and Si; X is at least one element selected from the group consisting of Y, Nb, Hf, Ta, La, Ce, Sm, Nd, Zr and Ti or Mm (misch metal); and x1 and y1 are each an atomic proportion and satisfy the relations $0.005 \leqq x1 \leqq 0.35$, $0.005 \leqq y1 \leqq 0.25$, and mechanically alloying the powder mixture thus obtained.

The above-mentioned aluminum powder is produced by the existing powder production process. It may be the powder of pure Al or an Al alloy containing Cr and/or Mg in an amount of up to 6 atomic % or less. The use of the aforementioned alloy exhibits the same effect as that by the use of pure Al.

The above-mentioned Al—T—X alloy powder, which is rapidly solidified, can be obtained by directly powdering the raw material by any of various atomizing methods, mechanical alloying (the MA method), mechanical grinding (the MG method) or the like; or tentatively forming the alloy in the form of thin ribbon, fine wire or thin film by the liquid quenching method, such as the single-roller melt-spinning method, twin-roller melt-spinning method or in-rotating-water melt spinning method or by the vapor deposition method, and then pulverizing the alloy.

In the foregoing Al—T—X alloy powder, the atomic proportions of x1 and y1 are limited to the range of 0.005 to 0.35 and to the range of 0.005 to 0.25, respectively. This is because proportions outside the above-mentioned ranges make it difficult to form an amorphous powder or a supersaturated solid solution exceeding the solid solution limit, and thus make it impossible to produce a rapidly solidified alloy powder having excellent strength and heat resistance (that is, an alloy powder consisting of an amorphous phase, a composite of an amorphous phase and a microcrystalline phase, or a microcrystalline phase), which is the objective product of the present invention. The amorphous phase thus obtained can be transformed into a microcrystalline phase by suitable heat treatment and, further, the crystal grain size and the size of the intermetallic compound can be controlled by controlling the temperature and time of the heat treatment. For the purpose of imparting excellent properties to the rapidly solidified powder material and the consolidated molding from the powder material, it is desirable that in the alloy powder, the average crystal grain diameter is 1 μm or smaller and the size of the intermetallic compound is 500 nm or smaller.

The element T in the Al—T—X alloy powder, which is at least one element selected from the group consisting of V, Cr, Mn, Fe, Co, Ni, Cu, Mo, W, Ca, Li, Mg and Si, exhibits the effect of improving the amorphizing capability in the presence of the element X, the effect of raising the crystallization temperature of the amorphous phase and an important effect of markedly improving the hardness and strength of the amorphous phase. In a microcrystalline alloy, the element T exhibits the effect of stabilizing the microcrystalline phase. The element T further forms a stable or metastable intermetallic compound with Al element and other element to be added and uniformly and finely disperses them in the Al matrix ($\alpha$-phase), thereby markedly enhancing the hardness and strength of the alloy. Still further, the element T suppresses the coarsening of the microcrystalline structure at an elevated temperature and imparts heat resistance to the alloy. On the other hand, the element X, which is at least one element selected from the group consisting of Y, La, Ce, Sm, Nd, Hf, Nb, Ta, Zr and Ti or Mm (misch metal), takes part in the effect of improving the capability to form an amorphous phase and raising the crystallization temperature of the amorphous phase, thereby remarkably improving the corrosion resistance of the alloy and enabling the stable existence of the amorphous phase up to an elevated temperature. In a microcrystalline alloy, the element X shows the effect of stabilizing the microcrystalline phase in the presence of the element T.

Al powder plays a role as binder when the above-mentioned Al powder and Al—T—X alloy powder are mixed together and the powder mixture is mechanically alloyed for further mixing. When consolidated and molded, the powder after mixing shows excellent properties with regard to the preservation of elongation at room temperature and strength at an elevated temperature. Moreover, the mechanical alloying (the MA method) pulverizes the oxide film on the surface of the rapidly solidified alloy powder, disperses the pulverized film in Al, minimizes the possibility of the aggregation of oxides, improves elongation at room temperature and thereby can produce a consolidated material with a low thermal expansion coefficient.

It is desirable that the above-mentioned Al powder be mixed so that the amount of the Al powder in the powder mixture is 20 to 90 atomic % and the total amount of Al in the aluminum-based alloy powder after the alloying is 92 to 98 atomic %. The reason for limiting the Al powder amount to 20 to 90 atomic % is that an amount outside the range impairs the role of Al powder as a binder and fails to impart the ductility inherent in Al powder to the powder after the alloying. The reason for limiting the total amount of Al after the alloying to 92 to 98 atomic % is that an amount less than 92 atomic % gives a powder that is liable to become brittle when consolidated and molded, whereas an amount exceeding 98 atomic % results in failure to assure the strength at room temperature.

The second aspect of the present invention relates to a process for producing a high strength aluminum-based alloy powder by mixing aluminum powder with an alloy powder having the composition represented by the formula $Al_{1-x2-y2}Ni_{x2}Ln_{y2}$, wherein Ln is at least one element selected from the group consisting of Y, La, Ce, Zr and Ti or Mm (misch metal); and x2 and y2 are each an atomic proportion and satisfy the relations $0.03 \leqq x2 \leqq 0.15$, $0.01 \leqq y2 \leqq 0.10$, and mechanically alloying the powder mixture thus obtained.

The reason for limiting the element T to Ni in the second aspect of the present invention is that the addition of Ni can provide excellent properties in strength and ductility in the range of from room temperature to an elevated temperature, lower the molding temperature during consolidation molding as compared with other elements and suppress the precipitation of intermetallic compounds that exert an adverse influence on the strength and ductility, which causes problems in the case of consolidation molding. The reason for limiting the element X to the aforestated element Ln, which is at least one element selected from the group consisting of Y, La, Ce, Zr and Ti or Mm, is that the addition of the Ln to an Al—Ni system facilitates the formation of an amorphous phase as well as the formation of intermetallic compounds with Al, which are easily dispersed finely in the Al matrix and thereby improve the strength. Further, the reason for limiting the amount proportions of Ni (x2) and Ln (y2) to 0.03 to 0.15 and 0.01 to 0.10, respectively, is that the above ranges lead to excellent properties in strength and ductility in the case of compacting and consolidating the resultant powder, followed by working, and to the preservation of the excellent properties of the consolidated material after being worked. By limiting $x2+y2$, in atomic proportion, to the range of 0.08 to 0.20, the quenching effect of the alloy is expected and the mixing by the mechanical alloying is facilitated. In addition, the amount of Al powder is restricted to the range of 20 to 90 atomic % and the total amount of Al after the alloying is restricted to the range of 92 to 98 atomic by the same reason as that in the first aspect of the present invention.

The third aspect of the present invention relates to a process for producing a high strength Al-based alloy powder by mixing Al powder with an alloy powder having the composition represented by the formula $Al_{1-x2-y2-z}Ni_{x2}M_zLn_{y2}$, wherein M is at least one element selected from the group consisting of Fe, Co, Mn and Cr; Ln is at least one element selected from the group consisting of Y, La, Ce, Zr and Ti or Mm; and x2, y2 and z are each an atomic proportion and satisfy the relations $0.03x2 \leqq 0.15$, $0.01 \leqq y2 \leqq 0.10$, $0.001 \leqq z \leqq 0.01$, and mechanically alloying the powder mixture thus formed.

In the third aspect of the present invention, the addition of element M, which is at least one element selected from the group consisting of Fe, Co, Mn and Cr, in an amount of 0.001 to 0.01 by atomic proportion, to Al—Ni—Ln alloy powder in the second aspect thereof, makes it possible to suppress the formation of an intermetallic compound which exerts a bad influence on the ductility and drastically improve the strength, especially at an elevated temperature.

The mechanical alloying (the MA method) as mentioned herein is a process comprising subjecting powder particles to dry pulverization under a high energy condition sufficient for pulverizing the powder particles as the raw material into fine particles in the presence of a pulverizing medium such as balls, and producing compact composite particles containing the fragments of the original powder and closely combined with each other or mutually dispersed through the combination of repeated pulverization with the fusing action. By the aforementioned treatment with high energy, an amorphous alloy can be directly obtained from a prescribed alloy.

The mechanical alloying (the MA method) includes a method using a ball mill in which balls and powder in a pot are allowed to collide with each other by the rotation of a rod placed at the center of the pot (attritor), and a method using a ball mill in which balls and powder in a plurality of pots are allowed to collide with each other by the rotation of the pots (planetary ball mill).

In the following, the present invention will be specifically described with reference to the examples.

EXAMPLES

Microcrystalline $Al_{88.5}Ni_8Mm_{3.5}$ powders prepared by a high pressure gas atomizing apparatus were classified and the resultant powder of 45 or 105 μm in size was used in the following experiment. The above powder was mixed in a prescribed amount of Al powder and the resultant powder mixture was mechanically alloyed by the use of a planetary ball mill under mixing conditions including a rotational speed of 200 rpm and a mixing time of 6 hours with ethanol mixed therein as an auxiliary. The powder thus obtained was packed in a copper capsule and extruded at a temperature in the range of 673 to 793 K to prepare an extruded material as the sample. The sample was examined for various properties including tensile strength (σ), ductility, Vickers hardness (Hv) and thermal expansion coefficient. For the purpose of comparison, the above-mentioned $Al_{88.5}Ni_8Mm_{3.5}$ powder was subjected to the above mechanical alloying treatment under the same mixing conditions as above and examined for the same properties as set forth above.

An amorphous $Al_{88.5}Ni_8Mm_{3.5}$ powder with a grain size of 22 μm or smaller was directly packed in a copper capsule and extruded. The extruded material was examined for the same various properties as set forth above. The results are given in Table 1.

TABLE 1

| | Mixing ratio | | Properties | | | | | | | | |
|---|---|---|---|---|---|---|---|---|---|---|---|
| | | | Tr | | | 300° C. | | thermal expansion coefficient ($10^{-6}$ $K^{-1}$) | | | |
| | $Al_{88.5}Ni_8Mm_{3.5}$ (at. %) | Al (at %) | σ (MPa) | elongataion (%) | Hv (DPN) | σ (MPa) | elongation (%) | 50-100 | 150-200 | 300-350 | specific gravity |
| Example 1 | 40 | 60 | 575 | 1.5 | 147 | 230 | 12 | 19.2 | 20.4 | 21.9 | 2.95 |
| Comparative Example 1 | 100 | 0 | 655 | 0.6 | 184 | 212 | 8.3 | 19.1 | 21.4 | 22.0 | 3.37 |
| Comparative Example 2* | 100 | 0 | 930 | 0.6 | 270 | 200 | 20 | 19.0 | 20.2 | 22.4 | 3.37 |

Comparative Example 2 relates to the consolidated material obtained by extruding the amorphous powder having a grain size of 22 μm or smaller without subjecting to the MA treatment.

As can be seen from Table 1, the production process according to the present invention can yield Al-based alloy powder having excellent tensile strength in an elevated temperature atmosphere (300° C.) as well as elongation and hardness at room temperature (Tr). It is also understood that according to the production process of the present invention, the Al-based alloy powder with a low thermal expansion coefficient is obtained and the powder is highly resistant to strain due to thermal stress and excellent in workability and reliability.

In the same manner as set forth in Example 1, examination was made using each of amorphous $Al_{85}Ni_5Y_{10}$ powder, microcrystalline $Al_{89.5}Ni_{6.5}Fe_1Mm_3$ powder, microcrystalline $Al_{88}Co_6Y_6$ powder and microcrystalline $Al_{88.5}Fe_8Mm_{3.5}$ powder in place of the microcrystalline $Al_{88.5}Ni_8Mm_{3.5}$ powder in Example 1. The results are given in Table 2 and Table 3.

TABLE 2

| | Mixing ratio | | | Properties Tr | | |
|---|---|---|---|---|---|---|
| | Alloy (at %) | | Al (at %) | σ (MPa) | elongation (%) | Hv (DPN) |
| Example 2 | $Al_{85}Ni_5Y_{10}$ (Amo) | 40 | 60 | 632 | 2.5 | 158 |
| Example 3 | $Al_{89.5}Ni_{6.5}Fe_1Mm_3$ (Cry) | 40 | 60 | 625 | 2.7 | 158 |
| Example 4 | $Al_{88}Co_6Y_6$ (Cry) | 40 | 60 | 472 | 0.3 | 129 |
| Example 5 | $Al_{88.5}Fe_8Mm_{3.5}$ (Cry) | 40 | 60 | 529 | 2.9 | 133 |

Remark:
Amo: Amorphous alloy
Cry: Microcrystalline alloy

TABLE 3

| | Properties | | | | |
|---|---|---|---|---|---|
| | 300° C. | | thermal expansion coefficient ($10^{-6}$ $K^{-1}$) | | |
| | σ (MPa) | elongation (%) | 50-100 | 150-200 | 300-350 |
| Example 2 | 281 | 7.5 | 19.1 | 21.0 | 23.5 |
| Example 3 | 246 | 6.1 | 18.7 | 20.0 | 22.7 |
| Example 4 | 198 | 0.1 | 18.6 | 20.1 | 21.4 |
| Example 5 | 209 | 1.9 | 18.5 | 20.3 | 21.8 |

It can be seen from Table 2 and Table 3 that as is the case with Example 1, the production process according to the present invention can give Al-based alloy powder having an excellent elongation and hardness at room temperature (Tr), and an excellent tensile strength at an elevated temperature (300° C.) and a low thermal expansion coefficient.

It is also understood from Table 2 and Table 3 that the alloy powder containing Ni as the element T exhibits properties superior to those of the alloy powder containing Co or Fe as the element T with respect to strength and elongation.

In the same manner as set forth in Example 1, examination was made using each of $Al_{90}Ni_7Zr_3$, and Al—Ni—Fe—V—Mm in place of the microcrystalline $Al_{88.5}Ni_8Mm_{3.5}$ powder in Example 1. The results obtained were similar to the foregoing results.

As described hereinbefore, the process for producing a high strength aluminum-based alloy powder according to the present invention can provide an aluminum-based alloy powder having excellent workability and reliability by virtue of its high strength stability in the temperature range of from room temperature to an elevated temperature, its excellent ductility in the same temperature range and its low thermal expansion coefficient in the same temperature range.

What is claimed is:

1. A process for producing a high strength aluminum-based alloy powder, which comprises mixing aluminum or aluminum alloy powder with a rapidly solidified powder having the composition represented by the formula $Al_{1-x1-y1}T_{x1}X_{y1}$, wherein T is at least one element selected from the group consisting of V, Cr, Mn, Fe, Co, Ni, Cu, W, Ca, Li, Mg and Si; X is at least one element selected from the group consisting of Y, Nb, Hf, Ta, La, Ce, Sm, Nd, Zr and Ti or Mm (misch metal); and x1 and Y1 are each an atomic proportion and satisfy the relations $0.005 \leqq x1 \leqq 0.35$, $0.005 \leqq y1 \leqq 0.25$, and mechanically alloying the powder mixture thus obtained.

2. The process according to claim 1, wherein the amount of the aluminum powder in the powder mixture is 20 to 90 atomic % and total amount of Al in the aluminum-based alloy powder after the alloying is 92 to 98 atomic %.

3. The process of claim 1, wherein said rapidly solidified powder has an average crystal grain diameter not exceeding 1 μm and contains intermetallic compounds having a size not exceeding 500 nm.

4. A process for producing a high strength aluminum-based alloy powder, which comprises mixing aluminum or aluminum alloy powder with a rapidly solidified powder having the composition represented by the formula $Al_{1-x2-y2}Ni_{x2}Ln_{y2}$, wherein Ln is at least one element selected from the group consisting of Y, La, Ce, Zr and Ti or Mm (misch metal): and x2 and y2 are each an atomic proportion and simultaneously satisfy the relations $0.03 \leqq x2 \leqq 0.15$, $0.01 \leqq y2 \leqq 0.10$, and mechanically alloying the powder mixture thus obtained.

5. The process according to claim 4, wherein the amount of the aluminum powder in the powder mixture is 20 to 90 atomic % and the total amount of Al in the aluminum-based alloy powder after the alloying is 92 to 98 atomic %.

6. The process according to claim 4, wherein x2 and y2 in the formula of said alloy powder to be mixed with the Al or Al alloy powder satisfy the relation, in atomic proportion, $0.08 \leqq x2+y2 \leqq 0.20$.

7. The process of claim 4, wherein said rapidly solidified powder has an average crystal grain diameter not exceeding 1 μm and contains intermetallic compounds having a size not exceeding 500 nm.

8. A process for producing a high strength aluminum-based alloy powder, which comprises mixing aluminum or aluminum alloy powder with a rapidly solidified powder having the composition represented by the formula $Al_{1-x2-y2-z}Ni_{x2}M_zLn_{y2}$, wherein M is at least one element selected from the group consisting of Fe, Co, Mn and Cr; Ln is at least one element selected from the group consisting of Y, La, Ce, Zr and Ti or Mm (misch metal); and x2, y2 and z are each an atomic proportion and satisfy the relations $0.03 \leqq x2 \leqq 0.15$, $0.01 \leqq y2 \leqq 0.10$, $0.001 \leqq z \leqq 0.01$, and mechanically alloying the mixture thus obtained.

9. The process according to claim 8, wherein the amount of the aluminum powder in the powder mixture is 20 to 90 atomic % and the total amount of Al in the aluminum-based alloy powder after the alloying is 92 to 98 atomic %.

10. The process according to claim 8, wherein x2, y2 and z in the formula of the alloy powder to be mixed with the Al or Al alloy powder satisfy the relation, in atomic proportion, $0.08 \leqq x2+y2+z \leqq 0.20$.

11. The process of claim 8, wherein said rapidly solidified powder has an average crystal grain diameter not exceeding 1 μm and contains intermetallic compounds having a size not exceeding 500 nm.

* * * * *

UNITED STATES PATENT AND TRADEMARK OFFICE

CERTIFICATE OF CORRECTION

PATENT NO. : 5 279 642

DATED : January 18, 1994

INVENTOR(S) : Katsumasa Ohtera

It is certified that error appears in the above-identified patent and that said Letters Patent is hereby corrected as shown below:

Column 7, line 11; change "Y1" to ---y1---.

Signed and Sealed this

Fourteenth Day of June, 1994

*Attest:*

*Attesting Officer*

BRUCE LEHMAN

*Commissioner of Patents and Trademarks*